United States Patent [19]

Kelly, Jr.

[11] Patent Number: 5,007,036

[45] Date of Patent: Apr. 9, 1991

[54] CASE CLOCK WITH ILLUMINATED PENDULUM

[75] Inventor: James H. Kelly, Jr., Hiawasee, Va.

[73] Assignee: Pulaski Furniture Corporation, Pulaski, Va.

[21] Appl. No.: 501,552

[22] Filed: Mar. 30, 1990

[51] Int. Cl.[5] ..... G04B 15/00; G04F 5/00

[52] U.S. Cl. ..... 368/134; 368/165; 368/179

[58] Field of Search ..... 368/134–138, 368/165–167, 179–183

[56] References Cited

U.S. PATENT DOCUMENTS

| | | | |
|---|---|---|---|
| 1,432,989 | 10/1922 | Favre-Bulle | 368/134 |
| 3,990,226 | 11/1976 | Fehrenbacher | 368/165 |
| 4,712,925 | 12/1987 | Beebe | 368/134 |

*Primary Examiner*—Vit W. Miska

*Attorney, Agent, or Firm*—William J. Daniel

[57] ABSTRACT

A light source is associated with the oscillating pendulum of a case clock to be energized during operation of the pendulum to achieve a striking ornamental effect as the light source moves with the oscillating pendulum.

17 Claims, 3 Drawing Sheets

CASE CLOCK WITH ILLUMINATED PENDULUM

FIELD OF THE INVENTION

This invention relates to the field of clocks and is concerned, more particularly, with case clocks including a swinging pendulum, particularly tall case clocks, often referred to as "Grandfather's" or "Grandmother's" clocks.

BACKGROUND OF THE INVENTION

Case clocks of the type including the swinging pendulum have been known in the art for well over 200 years. Traditionally, such clocks have been free-standing and of a height in the general order of about 5 to 7 feet, being commonly referred to as "Grandfather's" or "Grandmother's" clocks, depending upon their height. The same concept has been embodied into smaller clocks adapted to be suspended or hung from a supporting wall, but otherwise generally similar in configuration, although susceptible to more variation in design appearance. Thus, one well-known style of wall hanging clock is of the so-called "banjo" type, having a circular head housing the clock mechanism with an exposed clock dial face, from which is suspended a narrow elongated appendage within which the pendulum swings in oscillating fashion along an arc-like path. A variation is known as the "schoolhouse" clock in which the upper end housing the clockworks has an inverted generally V-shaped bonnet, reminiscent of the roof of a "schoolhouse", while the lower end is expanded in width compared to the banjo style and may terminate in an inverted truncated triangle. In contrast, tall case clocks usually have a vertically elongated generally rectangular configuration in front elevation, although an intermediate or waist section of the casing can often have a reduced width wise dimension extending between a wider upper end or hood section housing the clockworks and a wider base section. Of course, all of these forms can be provided with any of a wide variety of ornamental detail, according to the inspiration of the clock designer.

The appearance of case clocks have tended to follow traditional lines and, compared to other common items of furniture, have undergone relatively little evolution. The intermediate portion of the casing, within which is housed the swinging pendulum and in many instances vertically movable weights as well, is provided with a door on its front side and the solid doors which were characteristic of early models of such clocks are usually replaced now by framed doors carrying one or more glass panels or inserts through which the swinging pendulum and weights, where present, are visible and glass panels have likewise been added to the sidewalls of the intermediate section of the case. In addition, the early "stick" pendulum, in which a generally discoidshaped bob or head is supported from a narrow elongated rod-like stick, is in more recent times often replaced by a more highly ornamental pendulum of the so-called "lyre" type in which a considerably enlarged discoid head is supported from a generally vertically extending array of wires, ribbons, filaments and the like of ornamental, e.g., polished metal arranged in a general pattern reminiscent of the ancient musical instrument the lyre. Thus, the lyre-type pendulum is normally considerably more massive and more elaborate in design appeal than the traditional stick pendulum.

In either case, the function of the pendulum remains the same, namely, that of oscillating along an arcuate path so that as a result of such of such oscillation, the escapement mechanism of the clockworks is actuated periodically to allow a gear mechanism driving the hands of the clock to advance stepwise in controlled incremental fashion under the impetus of a driving force which is traditionally supplied by gravity-actuated weights, but can be replaced by wound springs or the like. The pendulum in turn receives from the escapement a driving impulse at one end of its oscillation stroke so as to thereby maintain the desired rate of oscillation and avoid gradual slowing down of the pendulum as would otherwise result from the action of gravity. When the intermediate section of the clock casing is provided with window panels or openings, the pendulum, whether of stick or lyre-type is constructed of ornamentally attractive materials, such as polished or satin-finished metal or the like in order to contribute to the beauty and aesthetic appeal of the clock when viewed through such panels or openings. However, the pendulum and weights, when present, can only reflect the light that is transmitted through the transparent panels or openings into the interior of the casing which often tends to be minimal in amount inasmuch as case clocks, ordinarily being valued possessions of their owners, are seldom located in direct sunlight or other brightly lighted situations, but rather tend to be located in more dimly-lit areas. Consequently, the full ornamental effect of the movement of the swinging pendulum is rarely if ever achieved, but rather tends to become obscured and lost within the relatively dark recesses of the interior of the case. There is thus a need in this art to enhance the attractiveness of the clock by providing illumination within the interior of the waist section of the casing and especially illumination which has an eye-catching appeal by virtue of movement thereof associated with the pendulum.

SUMMARY OF THE PRIOR ART

The utilization of illumination to enhance the aesthetic appeal of case clocks, especially grandfather and/or grandmother clocks, has been given scant to non-existent attention by clock designers. In U.S. Pat. No. 4,334,297, issued June 8, 1982, there is disclosed a so-called "globe" clock which includes a simulation of the earth as a globe supported on a shaft rotated at a speed of one revolution per minute to function as the second hand of a clock, a moon sphere supported on a separate shaft for translation around the earth globe at the rate of one revolution per hour to thus function as the hour hand of a clock, and a satellite sphere supported on an additional shaft with all but yet a different rate to function as the minute indicator of the clock. These components are enclosed within a housing with the visible surfaces of the shafts or other supporting members, as well as the visible interior surfaces of the housing, being painted black and the interior of the housing is illuminated under "black" light, e.g., ultraviolet light, thereby rendering the black surfaces essentially invisible and simulating the effect of the respective spheres revolving freely in dark space. Such a concept of a global clock obviously has no application to case clocks which incorporate a pendulum.

An unusual pendulum-type clock is disclosed in U.S. Pat. No. 4,712,925 in which the usual clock face is dispensed with and the pendulum itself is incorporated into the time indicating display, serving to designate the correct hour and intervals therebetween from among the usual hour indicating numerals arranged on a surface underlying the pendulum path, with the appropriate hour being identified by the position of the pendulum. In one embodiment of this concept, the hour indicating numbers are carried on an endless tape moving in along a loop-shape path intersecting at right angles to the plane of the arc of oscillation of the pendulum, the tape being advanced along such path in synchronization with the oscillation of the pendulum by means of a photo-electric cell arrangement which is interrupted when the pendulum swings across the path of the tape. While in such an arrangement, the bob of the pendulum might conceivably be partially illuminated incidentally during the operation of the clock, assuming visible light was employed as a photo-electric beam in lieu of invisible ultraviolet or infrared beams, any ornamental effect contributed by such illumination would be minimal due to its transitory nature and might even be considered a detraction to the appearance of the clock. In any case, the illuminating effect of such an arrangement could not follow the continuous movement of the pendulum inasmuch as achievement of the required synchronization requires isolation of the pendulum from the sensing beam of light in order that the former can periodically interrupt the latter so as to provide what is in effect a timing pulse.

The notion of an "electrified" pendulum in purely structural terms can be found e.g. in U.S. Pat. No. 1,432,989 where the pendulum bob actually takes the form of an electromagnetic coil which is suspended at its opposite ends from wires which actually serve as electrical leads to the coil. A magnet body is fixed to the clock casing in proximity to the arcuate path of the pendulum coil and current is supplied to the latter through the suspending leads periodically in such a way as to energize the coil temporarily during each of its swings and thus maintain its oscillating rate constant. A variation on this notion appears in U.S. Pat. No. 4,121,416, issued Oct. 24, 1978, where the relative positions of the electromagnetic coil and magnetic bar are reversed, with the coil being fixed on the housing of the clock and the magnet arranged in the form of a curved bar which is suspended beneath the pendulum and passes arcuately through the hollow core of the electromagnetic coil or solenoid. Electrical switches are disposed at the ends of the swinging arc of the magnet bar so as to be engaged thereby and briefly energized at the opposite terminations of such arc, thereby pulsing the solenoid to attract the bar in the opposite direction of its travel and to thus maintain a constant oscillating rate of the magnetic bar and thus of the clock pendulum from which it is suspended.

In both of these prior patents, the "electrification" of the pendulum has a strictly functional purpose, in effect replacing that portion of the escapement mechanism which applies an impulse to the pendulum during each of its strokes in order to maintain constant its oscillation rate. This is entirely unrelated to the idea of the electrification of a clock pendulum for ornamental illumination.

The very broad idea of modifying the structure of a clock pendulum in order to attract the attention of an observer is embodied in a bizarre arrangement in U.S. Pat. No. 1,035,418 wherein the clock face is combined with the representation of the face of a man having an arcuate mouth opening as a part thereof. The clock has a pendulum swinging in a concealed position behind the face and a cigar-shaped member projects through the mouth opening, being supported on a bracket suspended from the pendulum. Thus, when the pendulum of the clock oscillates, the cigar-shaped member swings from one side of the mouth opening to the other as an advertising display. Viewed from the standpoint of aesthetic appeal, the arrangement of this patent borders on the grotesque and certainly could not lead to the perception of the utilization of illumination as an ornamental enhancing feature.

OBJECTS OF THE INVENTION

One object of the present invention is therefore the provision of illumination within the interior of the waist or intermediate section of a case clock having a swinging pendulum which is visible through transparent panels or like openings formed in the front and/or sidewalls of the casing section.

Another object of the invention is a source of light mounted on the swinging pendulum of a case clock for movement therewith, such light source being provided with means for energizing the same electrically while moving with the swinging pendulum.

A further object of the invention is the provision of an electrically energizable light source within the interior of a hollow generally discoid-shaped pendulum head or bob which is provided with a light penetrable opening on at least one of its front or rear faces through which opening light rays from the light source are visible while the pendulum executes its swinging movement.

Yet another object of the invention is a light source carried by a swinging pendulum for illuminating the interior of the section of the clock casing housing such pendulum wherein the electrical leads for supplying electrical current to such light source extend lengthwise in generally concealed position down the length of such pendulum, such electrical leads being connected to a source of electrical current, preferably a low voltage source such as a 12–16 volt D.C. transformer or the like located within the clock casing and adapted to be connected in turn by conventional electrical lines to a household current electrical receptacle exteriorly of the clock.

A final object of the invention is a pendulum provided with an electrically energizable light source supplied with electrical current via electrical leads extending lengthwise of the pendulum, the suspension mechanism for such pendulum including a system of detachable electrical contacts which are brought together when the pendulum is suspended in such mechanism and become disconnected upon detachment of the pendulum therefrom.

BRIEF DESCRIPTION OF THE ACCOMPANYING DRAWINGS

Figure 4:
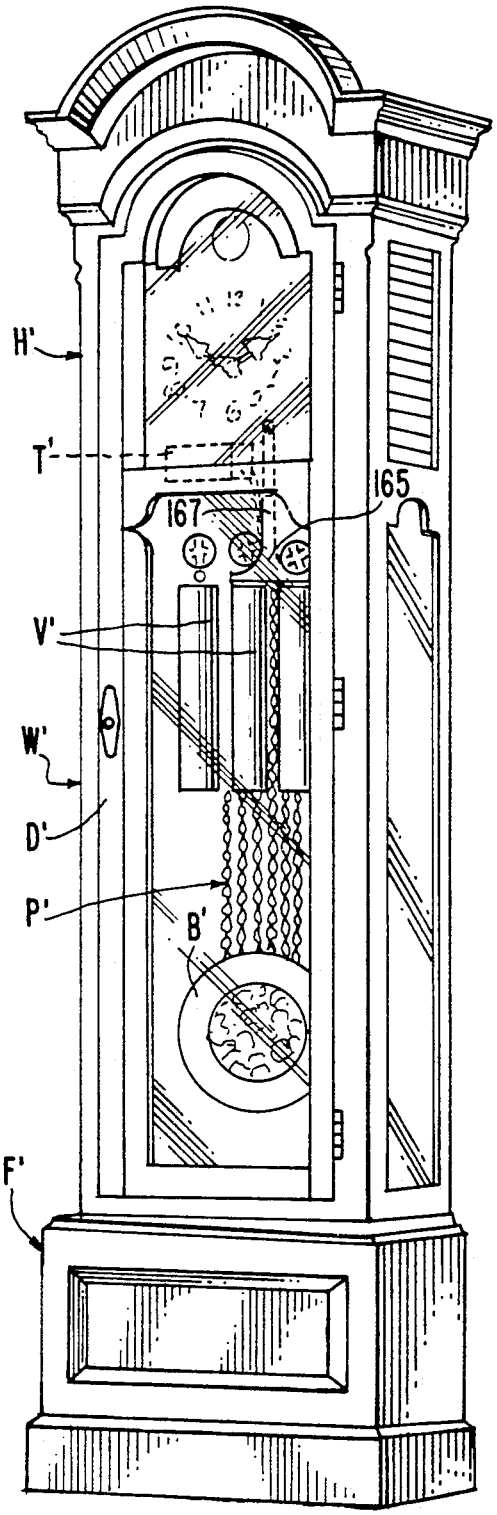
FIG. 4 is a front view slightly in right side perspective of a different form of traditional Early American tall case clock suitable for modification in accordance with the present invention which includes a pendulum of the complex lyre-type with a perforated pendulum head or bob.
Figure 5:
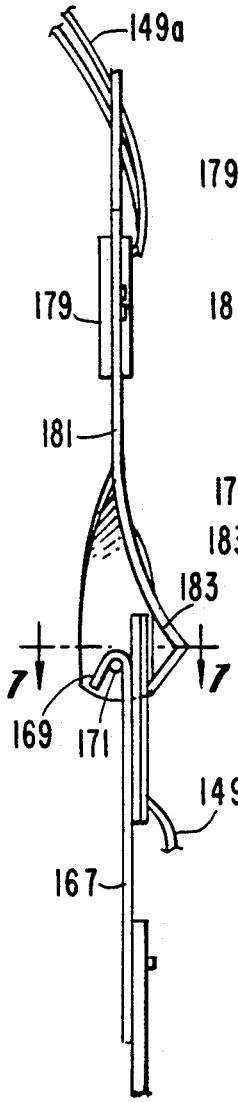
Figure 6:
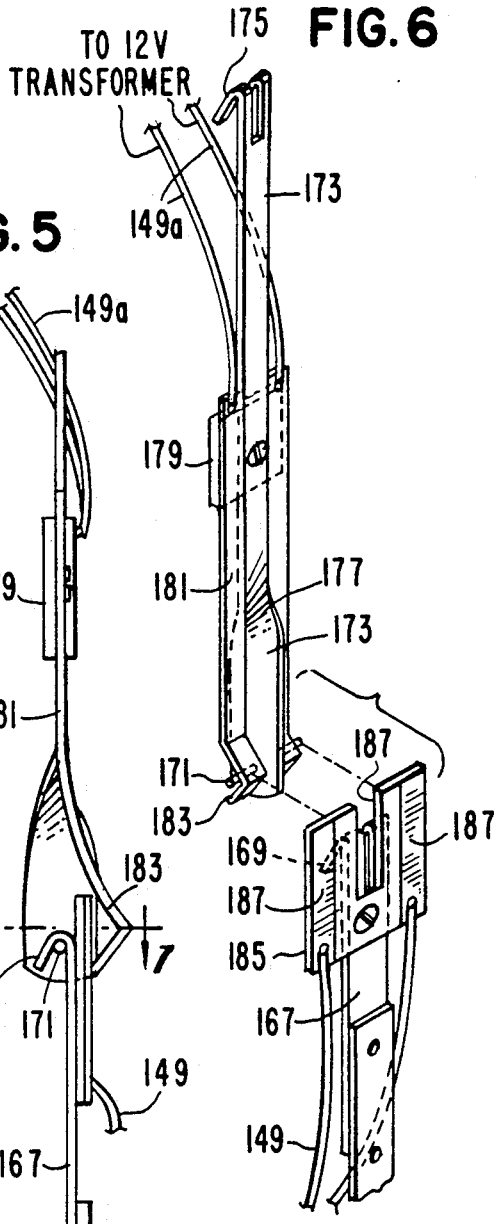
Figure 7:
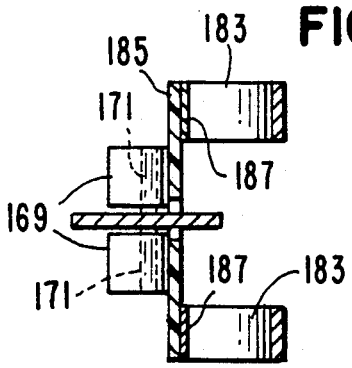
Figure 8:
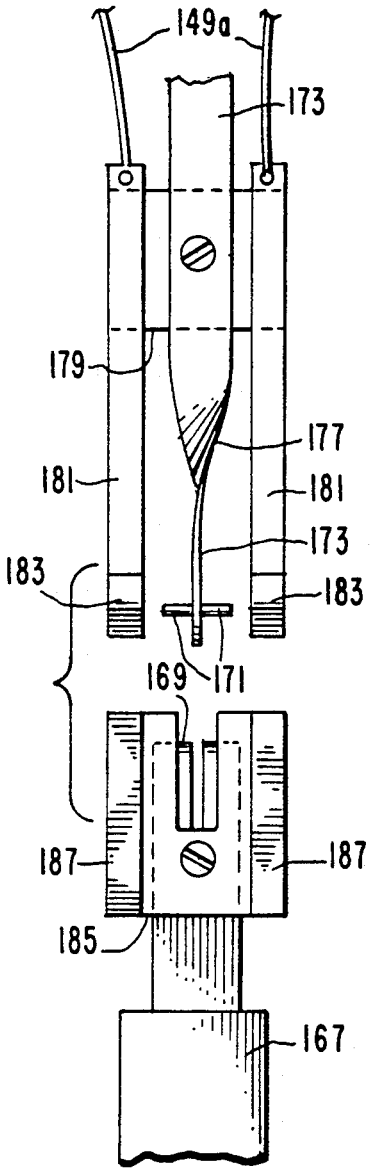
Figure 9:
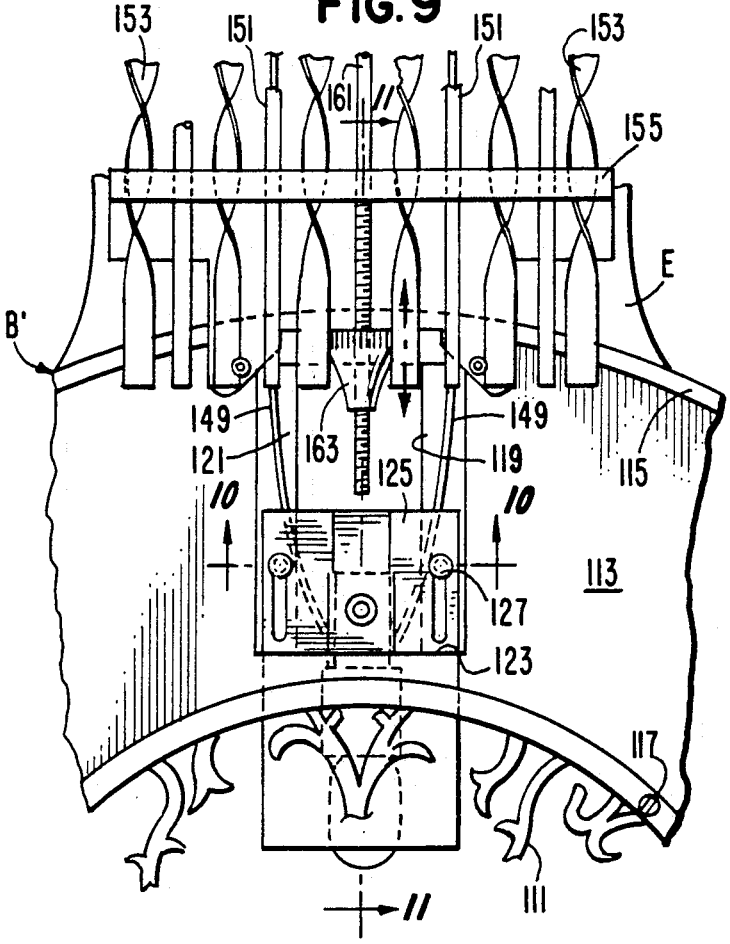
Figure 10:
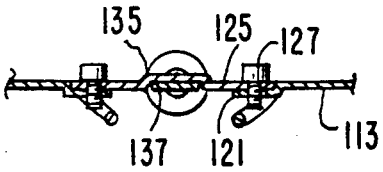
Figure 11:
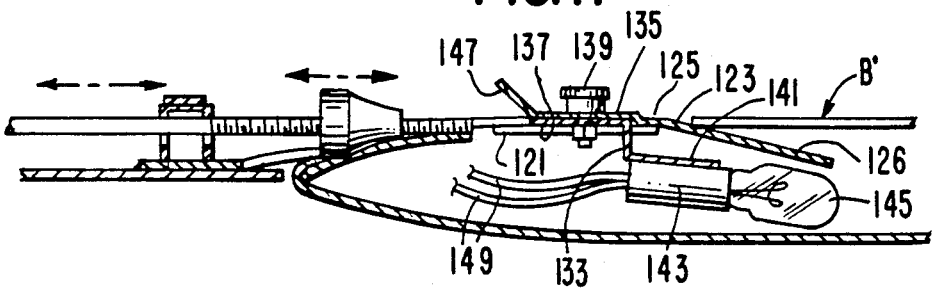

FIGS. 5 & 6 are greatly enlarged detail views of the suspension link for supporting the lyre-type pendulum together with the upper end of the pendulum lyre itself, both modified in accordance with the present invention to incorporate disconnectible electrical contacts which are brought into electrical connection when the hooked upper end of the pendulum lyre is attached in operative position to the lower end of the suspension link together with adjacent portions of the electrical leads leading to and away from such electrical contacts;

FIG. 7 is an enlarged detail view taken in section transversely of the pendulum adjacent the point of engagement between the hooked upper end of the pendulum and the suspension link generally along line 7—7 of FIG. 5;

FIG. 8 is a front elevational view likewise in enlarged detail of the suspension components shown in FIGS. 5 & 6 and showing further details of the electrical contacts and their mode of attachment to the respective supporting components;

FIG. 9 is a greatly enlarged fragmentary detail view of an upper segment of the perforated pendulum head or bob of the lyre-type pendulum of FIG. 4, showing the connection of such head to the supporting parts constituting the lyre together with the electrical light source mounted on the interior of the head segment and adjacent fragments of the electrical leads leading thereto;

FIG. 10 is a detail view taken in section through the electrical light source supporting bracket taken substantially along line 10—10 of FIG. 9; and FIG. 11 is an enlarged detail taken in vertical section substantially along line 11—11 of FIG. 9 and showing further details of the attachment of the light source supporting bracket to the annular wall of the pendulum head.

DETAILED DESCRIPTION OF ILLUSTRATIVE EMBODIMENTS

Figure 1:
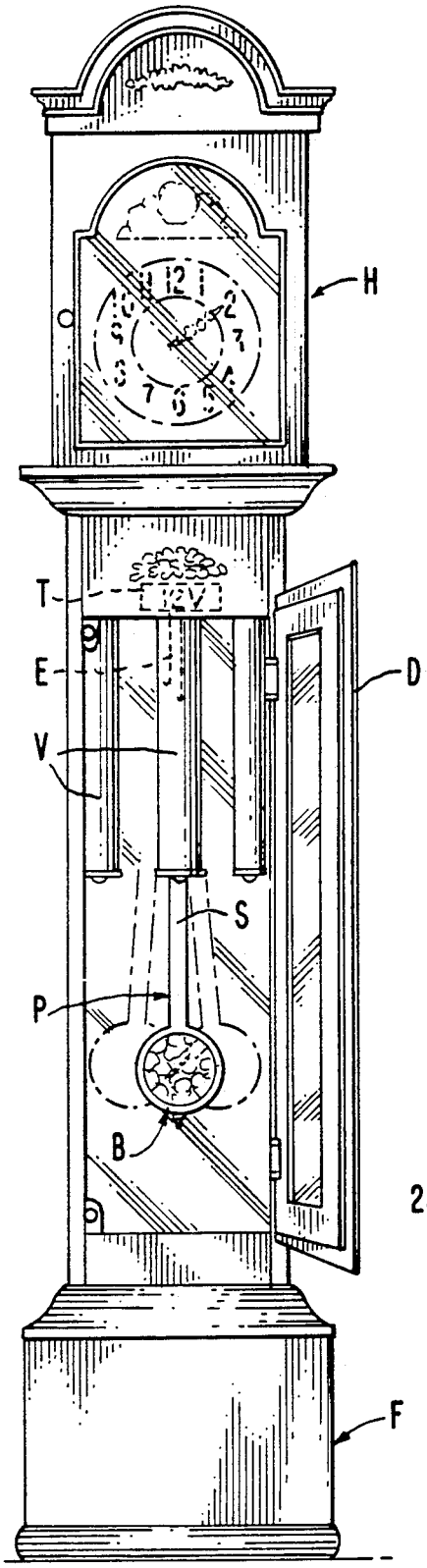
FIG. 1 is a front elevational view of a tall case clock, e.g. of the "Grandfather" type, in a traditional Early American design, having a stick-type pendulum with a perforated pendulum head or bob incorporating the concept of the present invention and showing in broken lines a low-voltage transformer and fragments of electrical leads.

A simplified version of a clock embodying the present invention is shown in FIG. 1 in order to illustrate the execution of concept of the invention. The clock in FIG. 1 is of the tall case variety and could be either of the grandfather or grandmother type, depending upon its overall height. While clocks according to the invention can reflect in their casing structure any of a variety of different furniture styles or periods, the clock in FIG. 1 is in a traditional Early American style and includes, as is usual for tall case clocks, an upper hood section H, a lower base section B and an intervening elongated waist section W. The latter, as can be seen in FIG. 1, is of reduced width wise dimension compared to the hood and base sections but could, of course, have a larger or smaller width. The clock is provided with various moldings and other ornamental details corresponding to its style, but such design details play no part in the present invention and will not be described further inasmuch as they are susceptible of wide variations. The "clockworks" are mounted within the hood section H with the face or dial of the clock, including the hands, being visible through an appropriate opening in the front face of the hood all through a transparent, e.g., glass, panel provided in an openable door in the front face of the hood. The clockworks themselves are concealed behind the face of the clock, being enclosed within the sidewalls and rear wall of the hood section of the casing.

As is visible in FIG. 1, housed within the interior of the waist section W is the swinging pendulum generally designated P, together with a plurality of weights, generally three in number, generally designated V. The weights are suspended on cables or chains and move downwardly under the force of gravity so as to supply the driving power for the clock mechanism, including the striking mechanism. When the weights reach their lower limit of travel, they must be rewound to their upper starting position by means of the pull chains or in some more modern systems, by means of winding handles, all as is well known in the art.

In accordance with the invention, the pendulum P is modified from its conventional structure to incorporate an electrically energizable light source. Ordinarily it is preferred that this light source be not visible by an observer facing generally the front side of the clock and hence the light source cannot be readily perceived in association with the pendulum P in FIG. 1, being merely suggested there by dotted lines. Electrical leads to energize the light source extend lengthwise of the pendulum and are likewise concealed by the pendulum so that they cannot be seen in FIG. 1, only a fragment of such leads being shown in dotted lines under the general designation E near the upper end of the waist section W. These leads are preferably supplied with low voltage current at a voltage level that is entirely safe for humans, say 12 or 16 volts D.C. and a transformer or other voltage converting device T is provided within the clock casing at a location concealed behind solid frame members of that casing. Obviously, the location of the transformer could vary widely and one possible location is suggested in dotted lines just above the front opening of the waist section W. That opening is intended to be closed by means of a swingable door designated D shown in open position in FIG. 1 and door D is constituted of a central elongated glass or other transparent panel carried within a vertically elongated frame and the swinging movement of pendulum P can be easily observed from the front exterior of the clock through the glass panel in door D. In some clocks of this type, similar glass panels are likewise provided in the left and right side panels of the waist section; all such side panels can be solid if preferred. In the preferred practice of the invention, the interior face of the rear or backwall of waist section W is constituted by a mirrored surface, suggested by shading visible through the open door D, inasmuch as the reflection of the lighted swinging pendulum from such mirror visible to an outside observer contributes to the ornamental attractiveness of the lighted pendulum feature of the invention.

In the clock of FIG. 1, the pendulum is of a simplified variety, generally referred to in the art as a "stick" pendulum. Such a pendulum includes an elongated stick-like supporting rod carrying adjacent its lower end a pendulum head or bob designated B normally of discoid-shape, although other shapes are certainly conceivable. Thus, pendulum bob B can have a circular configuration when seen in front elevation and a maximum thickness of, when viewed from the side, at its approximate center or axis, tapering from that maximum thickness to a rounded peripheral edge so as to define a hollow interior. It can be conveniently constituted to dish-shaped members of opposing concavity joined together along their peripheral edges or rims with their convex sides facing outwardly.

Figure 2:
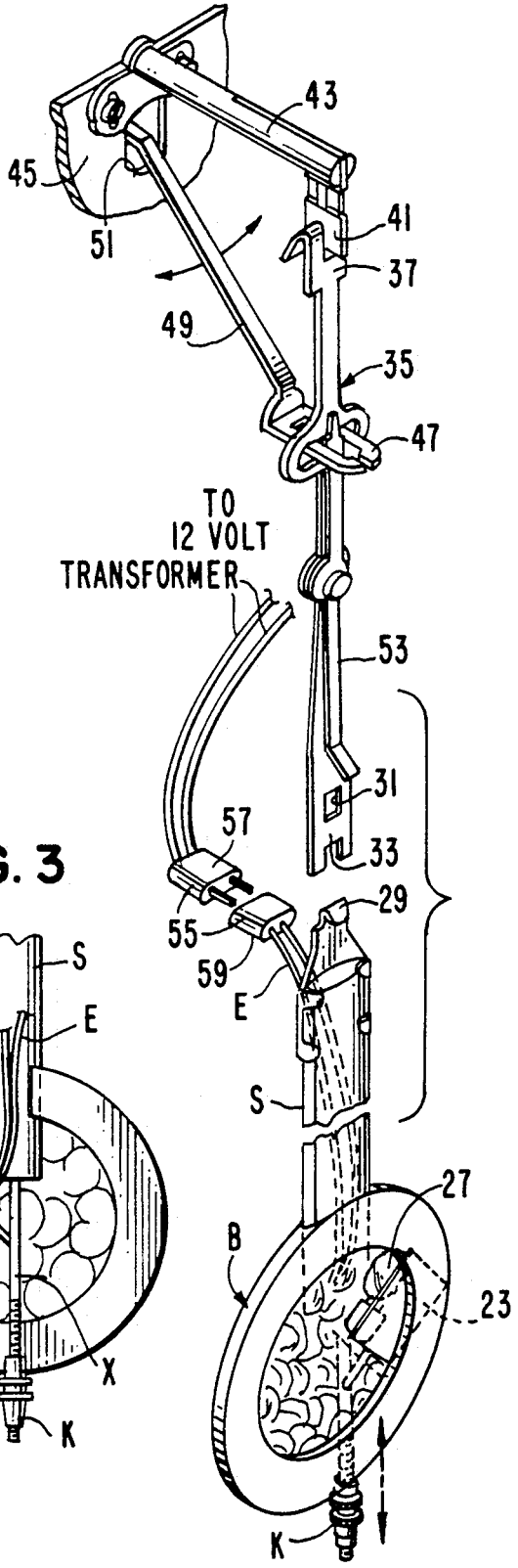
FIG. 2 is a detailed view, enlarged compared to FIG. 1, of a simple stick-type pendulum modified in accordance with the concept to the present invention together with the necessary components of the conventional anchoring mechanism of the clockworks for supporting the pendulum for its usual oscillating movement within the clock casing.
Figure 3:
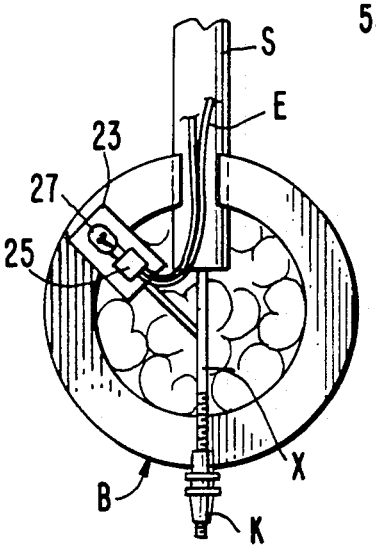
FIG. 3 is a partial detail view taken from the rear of the lower end of the simple stick pendulum of FIGS. 1 & 2, showing one way of mounting an electrical light source on the head or bob of the pendulum.

A simple pendulum structure of the clock of FIG. 1 is shown in more detail in FIGS. 2 & 3 and as is indicated in FIG. 3 in particular, the head or bob B is mounted at the lower end of stick S for limited lengthwise adjustment in order to be able to vary the effective length of the pendulum and thereby adjust its rate of oscillation and thus the rate at which the works of the clock are actuated by the swinging pendulum. In this way the clock can be adjusted to maintain accurate timekeeping and in the pendulum as shown, such adjustment is achieved by means of a knurled knob K which is in threadwise engagement with the threaded end of a rod-like extension at the lower end of pendulum stick S. knob K abuts against the lower rim of the pendulum head B and thereby determines the position of head B lengthwise of the end of the pendulum stick which passes through the interior of the bob B as shown.

In the execution of the invention, the light source can be associated with the pendulum head in any of a number of different ways. For example, the light source could be simply mounted on the exterior of the rear side of the bob B, for instance within a recess concavity provided thereon of the bob of a suitable size and shape as to receive the electrical socket for the light bulb with electrical leads extending from the socket into the interior of the bob and thence up the length of the pendulum. It is preferred, however, that the light source be disposed within the hollow interior of the pendulum bob in order to disturb as little as possible the overall ornamental attractiveness of the pendulum. One simple approach to this end has been shown in FIGS. 2 & 3 and, in this approach, the threaded extension E at the lower end of stick S is utilized to support the light source by means of an obliquely-extending supporting arm 21 branching from the extension rod E with a bracket 23 at its end on which is mounted an electrical socket with the light bulb 27 engaged therein. The electrical leads E extend from socket 25 along the rear side of pendulum stick S and can be affixed thereto along the pendulum length by means of suitable clips, strips of tape, or the like, not shown. In another option, the pendulum stick S can have a hollow interior and the electrical leads E can then be conveniently threaded through this hollow interior along the length of the stick to emerge to the exterior at the upper end thereof.

At its upper end, the pendulum stick S is constructed for a detachable connection to a suspension link which constitutes a part of the conventional anchoring and actuating mechanism for the pendulum and as seen in FIG. 2, the attachment means can take the form of a hooked upper end 29, which is adapted to be engaged through an opening 31 with the cross-piece 33 at the lower end of a suspension link generally designated 35. The upper end of suspension link 35 is formed as a forked hook 37, the hooks of which engage pins 39 projecting laterally for that purpose on either side of a suspension spring 41 which in turn is anchored in the so-called anchoring bridge assembly 43 secured to a rigid supporting frame member 45 situated within the interior of the hood section H of the clock casing. Thus, the suspension link 35 bridges between the suspension spring 41 anchored to the frame via the bridge assembly 43 and the hooked upper end 29 of the pendulum stick S. At a point spaced downwardly from its hooked upper end, the suspension link is engaged by the slotted end 47 of a lever arm 49 forming part of the anchor bridge assembly and projecting through an aperture 51 in the frame member 45. The interior end of lever arm 47, not visible in FIG. 2, is connected to the escapement mechanism of the clockworks and in response to the oscillating movement of the pendulum suspension link, transmitted thereto by the swinging pendulum itself, actuates the escapement mechanism to drive the clockworks in timed stepwise fashion. In turn, lever arm 49 receives a driving impetus delivered thereto by the clockworks driven by the descending weight of the corresponding hanging weight V, which impulse is transmitted by arm 49 to the suspension link in order to maintain the rate of oscillation of the pendulum constant and avoid the gradual retardation of the pendulum due to gravity. The suspension link 35 can include an adjusting finger 53 for adjusting the relationship of the slotted end 47 of the lever arm 49 and the axis of the link. The anchoring and suspension components for the clock embodiment seen in FIGS. 1–3 are conventional.

Since the stick pendulum P is adapted to be disengaged as a whole from its suspension link when the clock is to be transported from one place to another or for other reasons, it is desirable that the electrical leads to the illuminated pendulum of the invention be likewise adapted for disconnection at an appropriate point along their length, preferably, generally coincident with the hooked upper end of the pendulum stick. Such detachable connection is shown in FIG. 3 at 55 and takes a form of male and female electrical coupling components 57 & 59, respectively. From the disconnectible connection 55, the electrical leads extend to the electrical source, preferably by way of the low-voltage transformer T or other voltage converting device mentioned above, as the caption states in FIG. 3. This converting device can then be adapted to be connected by a conventional electrical line, not shown, to a wall receptacle of the conventional household type situated exteriorly of the clock. An off-on switch (not shown) can be provided at any convenient point in the circuit. It will be understood that all of the anchoring and suspension mechanism seen in FIG. 3 downwardly to point somewhat below the hooked upper end 29 of pendulum stick S is, when the pendulum is in operative position, effectively concealed either within the upper hood section of the clock casing or behind solid frame members bridging across the upper end of the waist section as shown. Consequently, none of these parts or any of the parts of the electrical coupling will be visible through the glass panel of the casing door D and thus detract in any way from the desirable appearance, ornamentally speaking, of the clock as a whole.

It will also be understood that the light source associated with the pendulum head could conceivably be energized in ways other than by electrical leads extending along the length of the pendulum and connected eventually to an external source of household current. It is conceivable, for example, that a low-voltage light bulb could be directly energized by means of appropriate batteries housed within the interior of the pendulum bob and adapted to be removed and replaced with fresh batteries when exhausted. Clearly, the need for periodic replacement of batteries is a disadvantage and it is consequently preferred to employ electrical leads connecting ultimately to a source of household current as already described.

When the light source is mounted within the interior of the pendulum bob, as is preferred, obviously provision must be made for the escape of the light rays to the exterior of the pendulum so as to become visible when the pendulum is in operative position within the clock casing. This can be done in several ways according to ones individual preference. For instance, the rear face of the pendulum bob could be constituted entirety of transparent or translucent material, such as of a molded plastic and, in particular, a central region of circular or other shape could be made transparent or translucent, leaving the remainder of the rear face intact as an annular exterior band united around its periphery with the periphery of the front side of the bob. In another variation, all or a central area could be perforated in an attractive pattern to form an ornamental grill or fretwork, with, in the latter case, a solid annular band around the periphery. Even more preferably, the front side of the pendulum bob is likewise modified so as to be penetrable by light from the interiorly disposed light source. Here again, all or at least a central part of the front side could be constituted by a transparent or translucent panel, particularly if the style of the clock in question were to be along more modern lines, perhaps of an art deco or even Scandinavian motif. For a more traditional style casing, especially one in the Early American style, the provision of a centrally disposed perforated grill-work section is more in keeping, stylistically speaking, and would ordinarily be more desirable. When the front side of the bob is modified to permit penetration by the light rays from the interior light source, then the rear side could be solid, but a more striking effect is believed to be achieved when light can pass through both the rear and front sides, especially if the interior of the waist section of the clock is provided with a mirror surface over at least its rear wall and optionally its sidewalls as well, assuming that the sidewalls do not include transparent glass panels of their own.

In FIG. 4 there is shown an alternative embodiment of a case clock embodying the present invention which is constructed in a style that is possibly more popular in the current market place, in which the pendulum has a more complicated structure of the so-called lyre configuration and is more massive in size and, hence, makes a stronger ornamental statement than does the simple stick-type pendulum of the original embodiment of FIG. 1. The clock in FIG. 4 is still along traditional stylistic lines, but would perhaps be categorized as being more reminiscent of the Empire style in contrast to Early American. As before, it includes the hood section H' at the upper end, a base section F', and an intervening waist section W', although in this instance the hood section and waist sections have the same width-wise dimension, exclusive of the crown at the top, instead of the waist being reduced or necked in as before, although the base is somewhat enlarged, both in width and depth-wise, for increased stability, as well as ornamental attractiveness. The waist section W', as before, includes an openable door D' covering its front opening, and the door is constituted by a large glass panel carried within a solid wooden frame. Both the left and right sidewalls of the waist section are in this case equipped with glass panels to the same height-wise extent as the glass panel in the front door.

The clock is equipped with a plurality of ornamental weights V' which under the influence of gravity supply the actuating energy to the clockworks housed within the upper hood section H' of which only the dial or face is visible through a glass panel located above the glass panel in the intermediate or waist section of the clock and enclosed within a frame. The latter can be formed integrally with the frame around the glass panel in the waist section to form a unitary door hinged at spaced points along one of its sides edges to a corner frame member of the clock case. In this instance, the several weights are provided with ornamental pulleys at their respective upper ends and a winding cable wraps 180° around each of these cables for winding onto take up drums, not visible when the weights are displaced upwardly to their starting positions.

The pendulum generally designated P' has a massive head or bob at its lower end designated 'which is of circular configuration, but considerably larger in diameter than that of the stick pendulum described before. For example, a typical diameter is in the order of 10 to 12 inches compared to a typical diameter for the stick pendulum bob of perhaps 4 to 5 inches. In the lyre-type pendulum, the vertical suspending portion, equivalent to the stick end of the previous version, is of much more elaborate construction and is normally constituted of a plurality of vertical extending suspension elements disposed in laterally spaced apart flat parallel relation. These elements can take various forms, including solid rods, hollow tubular rods, narrow ribbons, either flat or helically twisted and so on, and typically several different configurations are combined in a predetermined series of alternation or grouping into a common array, according to a particular designer's preference. Often, there may be superimposed upon the vertical array of such elements a flat ornamental sheet member cut out in the silhouette of an ancient lyre, but this feature has been omitted in the embodiment of FIG. 4 for sake of clarity and to avoid possible confusion.

Although the case clock of FIG. 4 is indeed provided with an illuminated pendulum according to the present invention, that fact is not at all evident in the overall view of FIG. 4 because the added components have been effectively concealed within the standard parts of the clock. Thus, the various vertical suspension elements of the lyre lend themselves to the association therewith of vertically extending electrical leads and, in particular, where at least two of such elements are of hollow tubular form, the leads can be threaded through the interiors thereof from one end to the other and thus concealed from view. Similarly, the massive size of the pendulum head in this instance serves well for the interior incorporation of the light source and the front and rear sides of the pendulum head can be penetrated in whole or in part to form an ornamental grill-work or otherwise rendered penetrable, at least in part, by the light rays emanating from the interior light source.

One specific construction of light source on the pendulum head is shown in detail, looking st the rear side of the pendulum, in FIG. 9. In this construction, a central portion of at least the rear side of the pendulum bob generally designated B' is perforated in an ornamental scroll work design as at 111, being surrounded by a solid annular band, perhaps of 2 to 3 inches of annular radius, as an example, designated 113, which is joined around its exterior rim to the front side of the head by means of a rounded roll seam suggested at 115. The perforated scroll work central section can be made separate and removable from the solid annular section being attached thereto by small ornamental screws, one of which is seen at 117.

Only a top segment of the entire pendulum head B' has been included in FIG. 9 and in the medial portion of this segment, aligned with the center axis of the overall pendulum, a radial slot or aperture 119 is cut in the annular band section, extending from near its inner extremity to near its outward extremity. The margins along the sides of the radial aperture 119 are depressed inwardly so as to form slightly recessed lips along the aperture side, as at 121, which lips are separated at their interior ends from the contiguous portions of the annular band 113 to define lateral notches 123 on either side of the inner end of aperture 119. The radial aperture 119 is covered by a slidable cover plate 125 which overlaps along its side edges with the recessed margins 119. At its inner end, the cover plate 125 is deflected arcuately inwardly as at 126 and its inner end is adapted to pass through the aperture 119 and notches 123 into the interior space between the front and rear faces of the pendulum bob. The radial position of the cover plate along the radial slot 119 is adjustable, an extreme inner position being shown, and, if desired, the cover plate can be secured in any given radial position by means of knurled securing screws 127, which are threadwise engaged with threaded holes provided in the recessed margins 121 and cooperating elongated slots 129 provided adjacent the side edges of the cover plate 125.

Depending from the underside of the radially adjustable cover plate 125 is an angular bracket 133 for supporting the light source within the interior of the discoid-shaped pendulum bob B'. Preferably the center portion of the cover plate 125 is deformed upwardly as at 135 to form a shallow downwardly opening depression in which the base leg 137 of bracket 133 is adapted to be received and to be affixed to the overlying cover plate by means of a short knurled bolt and nut 139. To the inner leg 141 of bracket 133 is attached by means of rivets or the like, not shown, the socket 143 of the light source in which an electrically energizable light bulb, preferable of the low-voltage type, is seated either by means of threads or a snap fit. A tab 147 is bent upwardly from the radially outward end of cover plate 125 so as to facilitate its radial adjustment so as to locate the light bulb 145 at a desired radial position. During such adjustment the side edges of the cover plate 125 are supported by the depressed marginal regions 121 of the rear side 113 of the discoid pendulum head B'. As the cover plate is being adjusted, the locking screws 127 are of course loosened and once the proper position for the plate has been achieved, the locking screws are then tightened to hold the cover plate in place at the selected position. The electrical leads 149 from the electrical socket 143 extend exteriorly the interior of the pendulum bob through the outer end of radial slot 119 and, as can be seen in FIG. 9, are preferably threaded through the interior of two spaced apart hollow tubular elements 151 which form part of the array of decorative longitudinal elements constituting the suspension portion of the lyre-shaped pendulum, as discussed above. It will be seen from FIG. 9 that the tubular elements 151 are arranged in alternation with helically twisted elongated flat ribbon-like elements 153 and it will be understood that the number and sequence of the ornamental longitudinal elements represented by 151 and 153 are subject to wide variation.

The lower ends of the longitudinal suspension elements 151, 153 are clamped in longitudinal sliding relationship to the upper portion of the discoid pendulum bob B' by means of a clamping bar or bracket 155 which bridges across the lower end of such elements and is anchored rigidly using rivets or bolts, etc. to the pendulum bob, for instance by way of an upward extension E indicated at 157 which can, in fact, constitute part of the ornamental flat lyre-shaped sheet metal member mentioned above as being omitted for sake of clarity. As with the original embodiment, it is desirable for the effective or working length of the overall pendulum to be capable of limited adjustment in order to accurately control the rate of oscillation of the pendulum and thus its timekeeping ability. To this end, the longitudinal suspension member coinciding with the center axis of the pendulum bob and thus situated at the mid-point of the array of longitudinal suspension members, which is specifically designated 161 in FIG. 9, is constructed in solid tubular form and its lower end is threaded for threadwise engagement with a knurled nut 163 which abuts at its flat upper end against the radially outward edge of slot 119. Such abutment prevents downward movement of the pendulum bob beyond the point determined by the flat upper end of the knurled nut 163 and thus as that nut is rotated on the threaded end of element 161, the relative position of the bob B' is correspondingly adjusted.

The upper ends of the array of longitudinal suspension elements have not been shown in the drawings, but, as is suggested in the overall view of the clock in FIG. 4, the upper ends of such elements are clamped to the backside of a suspension tongue 165 by means of a clamping bridge or bracket similar to bridge 155 and riveted or otherwise affixed to the suspension tongue 155. The upper ends of the suspension elements 151, 153 and the like therefor lie behind the flared lower end of tongue 155 and are concealed from sight thereby. The upper ends of electrical leads 149 thus emerge from the upper ends of the selected tubular elements 151 and extend up the rear side of suspension tongue 165 so as to be hidden from view, being secured by means of appropriate clips, strips of tape or the like.

While a disconnectible electrical coupling of the type shown in FIG. 2 at 55 could be employed with the modified embodiment of FIG. 4, it is much preferred that the mechanical connection between the upper end of the pendulum as a whole and the suspension link anchored to the casing of the clock be modified so as to "automatically" create an electrical connection between associated separable electrical contacts when the pendulum and its suspension link are assembled and, conversely, to bring about an electrical disconnection when these elements are detached one from the other. Such a modification is shown in detail in FIGS. 5 through 8. As can be seen in FIG. 4, the suspension tongue 165 narrows to strip form 167 at its upper end for suspension purposes and extends out of view up into the lower end of the hood section of the clock to the point of its suspension connection. As seen in FIGS. 5 & 6, in particular, its upper end is formed into a forked hook 169 which is adapted to be engaged when the pendulum is brought into its hanging operative position on pins 171 extending transversely on either side of the lower end of the suspension link 173. At its upper end, suspension link 173, which corresponds to suspension link 35 in the original embodiment, is adapted for engagement with a suspension spring, which is not shown but is similar to suspension spring 41 in FIG. 2, which in turn is anchored on the anchoring assembly as described before. For this purpose, the upper end of suspension link 173 is formed as a forked hook. Link 173 at a point intermediate its ends, as at 177, can be given a 90° twist so as to bring its respective ends into proper alignment for their mechanical connection.

Along the length of suspension link 173 is affixed, e.g., with rivets an insulating block 179 which projects laterally to either side of the link to form the anchoring point for the ends of resilient electrical contact spring fingers 181 which extend to the lower end of the link, but are electrically isolated therefrom, and are preferably arched or bowed at their extreme lower terminations, as at 183, so that each lower end presents an inclined surface relative to the lengthwise axis of the link. Adjacent the upper end of suspension tongue 165, another rigid insulation block 185 is attached, again using rivets, etc. for securing purposes, which block projects laterally to either side of the narrow tongue section 167 and is slotted midway of its upper end as at 187 to expose the separation between the forks of the hooked end 169 of the tongue. Electrical contacts strips 187 are affixed to side margins of the insulating block 185, being maintained thereby insulated from the tongue 167 and the ends of electrical leads 149 extending up the pendulum are soldered to these contact strips. When the forked hook end 169 of tongue 167 is brought into engagement with the transverse pins 171, the contact strips 187 make contact with the inclined ends 185 of the spring fingers 181 and displace the same resiliently from their normal position and thereby create a positive electrical contact between the spring fingers and the contact strips.

The manner in which the spring fingers and contact strips cooperate to achieve a secure electrical connection when the pendulum and suspension link are assembled is not critical and can be changed. As shown in FIGS. 5 & 6, the electrical strips are disposed on the front face of the insulating block 185 while the lower ends of the spring fingers are bent into rearwardly opening v-shape so that when brought into cooperating relationship to establish electrical contact, the end edges of the spring fingers are deflected forwardly and bear against the contact strips with spring force. Alternatively, and more perhaps more preferably, the electrical contacts can be mounted on the opposite rear face of insulating block 185 so that as the parts are assembled, the upper leading edge of the insulating block and the contact strips carried thereon exerts a kind of camming action against the inclined lower end of the spring fingers, causing the same to be deflected rearwardly to bring the corner of the bent end of the spring fingers into resilient contact with the contact strips. Other relationships are of course possible.

The extension 149*a* of the electrical leads 149 has the ends thereof soldered to the upper ends of the contact spring fingers 181 and extend up into the interior of the hood of the clock for connection to the low-voltage transformer or other voltage converting device provided there, as already explained, and suggested in dotted lines at T' in FIG. 4. The location for transformer T' in FIG. 4 is selected arbitrarily merely for illustration purposes and any out of the way location within the hood where space is available would be suitable. It will be appreciated that when the pendulum is assembled in operating position, as shown in FIG. 4, all of the mechanical suspension components, that is the suspension link, the hooked forked end 169, etc., as well as the components related to the electrical coupling are not visible to view from the exterior through any of the transparent panels provided in the casing, but are rather concealed from view by frame components and/or the face of the clock so as to not detract from the aesthetic appearance of the overall clock.

In the course of the preceding detailed description, reference has been made to possible variations and modifications in the embodiments that had been selected for exemplification and it will of course be appreciated that additional variations and modifications are readily possible. More importantly, the concepts that have been disclosed could, by the exercise of the skill of the art, be embodied in constructions differing from those that have been illustrated. Accordingly, the scope of the present invention is not to be restricted to the details of the particular embodiments described above, but is defined only by the language of the appended claims.

What is claimed is:

1. In a clock having a casing and a pendulum housed within a section of said casing adapted for oscillating movement along an arc, said casing section having at least one opening therein through which said pendulum is visible from the exterior, said pendulum including an arm anchored within said casing at its upper end for said oscillating movement, and carrying adjacent its lower end a head, in combination, the improvement of illuminating means for said pendulum head comprising a light source energized by an electrical current and mounted on said pendulum head, and means for supplying electrical current to said light source to energize the source while said pendulum is oscillating.

2. The clock of claim 1 including electrical conduit means having an exterior section adapted to be connected to a household electrical receptacle and an interior section within said casing, said interior section including electrical leads extending along the length of said pendulum arm from adjacent the anchored end thereof and connected to said light source on said head.

3. The clock of claim 2 wherein said light source is mounted on said pendulum head in a position generally concealed by the head from said visibility through casing opening and said electrical leads are concealed by the pendulum arm.

4. The clock of claim 2 wherein said electrical conduit means includes voltage reduction means within said casing for converting a voltage of the electrical current from the household electrical receptacle to a harmless low voltage prior to delivery of said current to said electrical leads and thence to said light source.

5. The clock of claim 2 wherein at least a portion of the pendulum arm is of an elongated hollow tubular configuration and said electrical leads pass within the hollow interior thereof.

6. The clock of claim 5 wherein the upper end of such tubular arm portion is spaced downwardly from the anchored upper end of said arm and the lower end thereof is within the perimeter of said head.

7. The clock of claim 2 including pendulum arm anchoring means supported within said casing and connecting means at the upper end of said arm for detachably connecting said arm to said anchoring means, and said interior electrical portion includes disconnectible electrical coupling means for said electrical leads extending along the pendulum arm for disconnecting the same from the remainder of said electrical conduit means to enable said pendulum arm to be detached.

8. The clock of claim 7 wherein said pendulum arm anchoring means includes a suspension-link having a cross-bar at its lower end, said arm carries at its upper end hook means for detachably engaging said cross-bar to support said pendulum arm and head from said link, and the detachable electrical coupling includes cooperating sets of sliding electrical contacts associated with said cross-bar and hook means, respectively, at least one set of said contacts being resilient and being adapted to move into and out of sliding relationship with the other set of contacts when said hook means and cross-bar are attached and detached.

9. The clock of claim 8 wherein said contacts are arranged in laterally spaced pairs and are supported on the respective suspension link and hook means on rigid blocks insulated from the hook means and suspension link, said electrical leads being connected to the contacts associated with said arm and being insulated along their length.

10. The clock of claim 9 wherein the ends of said resilient set of contacts are arcuately bent to facilitate making of a sliding relationship with the other contacts.

11. The clock of claim 1 wherein said pendulum head is of hollow generally discoid-shape with the faces thereof generally parallel to the plane of the arc of oscillation, at least the rear face being penetrable to light over at least a portion of its area, and said light source is disposed within the hollow interior of said head.

12. The clock of claim 11 wherein at least the rear wall of the casing section housing the pendulum is a mirror surface and said source includes means shielding said light source from direct reflection in said mirror.

13. The clock of claim 11 wherein the central regions of both the front and back faces of said discoid pendulum head are penetrable by light whereby light from said light source in the head interior is visible through both said penetrable regions.

14. The clock of claim 13 wherein said central regions are constituted by ornamental grill-work.

15. The clock of claim 11 wherein the front and rear faces of said discoid pendulum head have central light penetrable regions surrounded by annular impenetrable regions and the interior light source is disposed generally within said impenetrable regions so as to be substantially shielded thereby from direct view.

16. The clock of claim 11 wherein said light source is adapted for limited radial adjustment relative to said discoid head to facilitate positioning of the same within said annular regions.

17. The clock of claim 1 including a light shielding plate overlying the front side of said light source to shield against direct frontal visibility thereof.

* * * * *

UNITED STATES PATENT AND TRADEMARK OFFICE

CERTIFICATE OF CORRECTION

PATENT NO. : 5,007,036

DATED : April 9, 1991

INVENTOR(S) : James H. Kelly, Jr.

It is certified that error appears in the above-identified patent and that said Letters Patent is hereby corrected as shown below:

Column 14

Claim 3, line 3, after "from" cancel "said" and after "through" insert --said--.

Signed and Sealed this

Twenty-eighth Day of July, 1992

*Attest:*

DOUGLAS B. COMER

*Attesting Officer*

*Acting Commissioner of Patents and Trademarks*